US009200551B2

(12) United States Patent
Okuda et al.

(10) Patent No.: US 9,200,551 B2
(45) Date of Patent: Dec. 1, 2015

(54) EXHAUST TREATMENT APPARATUS FOR ENGINE

(71) Applicant: KUBOTA Corporation, Osaka-shi, Osaka (JP)

(72) Inventors: Mitsugu Okuda, Sakai (JP); Yoshikazu Takemoto, Sakai (JP); Takashi Onishi, Sakai (JP); Hozumi Ishida, Sakai (JP); Manabu Miyazaki, Sakai (JP); Yuichi Tamaki, Sakai (JP); Tomoya Akitomo, Sakai (JP); Katsuaki Arai, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 14 days.

(21) Appl. No.: 14/108,464

(22) Filed: Dec. 17, 2013

(65) Prior Publication Data

US 2014/0174061 A1 Jun. 26, 2014

(30) Foreign Application Priority Data

Dec. 26, 2012 (JP) ..... 2012-282323
Mar. 29, 2013 (JP) ..... 2013-073251

(51) Int. Cl.
*F01N 3/10* (2006.01)
*F01N 3/36* (2006.01)
(Continued)

(52) U.S. Cl.
CPC ..... *F01N 3/10* (2013.01); *F01N 3/0256* (2013.01); *F01N 3/36* (2013.01); *F01N 3/323* (2013.01)

(58) Field of Classification Search
CPC ..... F01N 3/10; F01N 3/0256; F01N 3/36; F01N 3/323; F01N 3/025; F01N 3/035; F01N 2240/14; F01N 3/00; F01N 3/023; F01N 3/0231; F01N 3/0253; B01D 53/9495
USPC ..... 60/272–324; 422/109
See application file for complete search history.

(56) References Cited

U.S. PATENT DOCUMENTS 5,771,683 A 6/1998 Webb
2005/0150217 A1 * 7/2005 Crawley et al. ..... 60/295
(Continued)

FOREIGN PATENT DOCUMENTS

JP 2012-188971 A 10/2012
JP 2012-188972 A 10/2012
(Continued)

OTHER PUBLICATIONS

Extended European Search Report issued Mar. 25, 2014 in EP Application No. 13250126.3.

*Primary Examiner* — Jason Shanske
*Assistant Examiner* — Kelsey Stanek
(74) *Attorney, Agent, or Firm* — Panitch Schwarze Belisario & Nadel LLP

(57) ABSTRACT

An exhaust treatment apparatus for an engine including a combustible gas supplying passage; a heat releasing port opened in an upstream side in the exhaust passage from the oxidation catalyst and in a downstream side in the combustible gas supplying passage, the exhaust passage and the combustible gas supplying passage communicating with each other through the heat releasing port; an ignition apparatus beneath the heat releasing port, the heat of flaming combustion of combustible gas ignited by the ignition apparatus being supplied to the exhaust passage to raise the temperature of exhaust in the exhaust passage; a flame holding plate in a downstream side in the combustible gas supplying passage from the ignition apparatus, an exhaust guiding plate at the top portion of the flame holding plate, the exhaust guiding plate having an upward slope toward a downstream side in the exhaust passage.

17 Claims, 6 Drawing Sheets

(51) Int. Cl.
*F01N 3/025* (2006.01)
*F01N 3/32* (2006.01)

(56) References Cited

U.S. PATENT DOCUMENTS

2007/0289296 A1 12/2007 Goulette et al.
2010/0077731 A1* 4/2010 Jeong et al. ..... 60/286

FOREIGN PATENT DOCUMENTS

JP 2012-188973 A 10/2012
JP 2012-188974 A 10/2012
JP 2013-189954 A 9/2013
JP 2013-189955 A 9/2013
WO 2011118635 A1 9/2011

* cited by examiner 53
53a
53b
53c
53d
53e
53f
53g
53h
53i
53j
4a
30°
36°
B
C
D
E
54
47
47a
47b
47c
47d
42
46
17°
42°
G
52
52a
52b
52c
52d
52f
52g
52j
23°
I

EXHAUST TREATMENT APPARATUS FOR ENGINE

BACKGROUND OF THE INVENTION (1) Field of the Invention

The present invention relates to an exhaust treatment apparatus for an engine. Specifically, the present invention relates to an exhaust treatment apparatus for an engine that can improve continuance of combustion flame of combustible gas.

(2) Description of Related Art

A conventional exhaust treatment apparatus for an engine includes an oxidation catalyst disposed in an exhaust passage, a combustible gas generator, and a combustible gas supplying passage. The combustible gas supplying passage is disposed in parallel to and beneath the exhaust passage. A heat releasing port is opened in an upstream side in the exhaust passage from the oxidation catalyst and in a downstream side in the combustible gas supplying passage. The exhaust passage and the combustible gas supplying passage communicate with each other through the heat releasing port. An ignition apparatus is disposed beneath the heat releasing port. The heat of flaming combustion of combustible gas ignited by the ignition apparatus is supplied to the exhaust passage to raise the temperature of exhaust in the exhaust passage. A flame holding plate is provided beneath the heat releasing port in a downstream side in the combustible gas supplying passage from the ignition apparatus (e.g., see FIGS. 1A and 2 of JP 2012-188972 A).

The exhaust treatment apparatus of this type is advantageous in that the oxidation catalyst can be activated even when the temperature of exhaust is low, because the temperature of exhaust is raised by the heat of flaming combustion of combustible gas.

However, this conventional technique involves a problem since the ignition apparatus is exposed to the exhaust passage from beneath.

<<Problem>>

Continuance of combustion flame of combustible gas is poor.

Since the ignition apparatus is exposed to the exhaust passage from beneath, exhaust that passes the exhaust passage tends to enter the area surrounding the ignition apparatus from above the ignition apparatus. Accordingly, exhaust tends to blow off combustion flame of combustible gas, and thus continuance of combustion flame of combustible gas is poor.

SUMMARY OF THE INVENTION

An object of the present invention is to provide an exhaust treatment apparatus for an engine that can improve continuance of combustion flame of combustible gas.

The invention-specific matters of the invention according to claim 1 are as follows.

As illustrated in FIGS. 1A and 2, an exhaust treatment apparatus for an engine includes: an exhaust passage (4); an oxidation catalyst (5) that is disposed in the exhaust passage (4); a combustible gas generator (1); a combustible gas supplying passage (8) that is disposed in parallel to and beneath the exhaust passage (4); a heat releasing port (13) that is opened in an upstream side in the exhaust passage (4) from the oxidation catalyst (5) and in a downstream side in the combustible gas supplying passage (8), the exhaust passage (4) and the combustible gas supplying passage (8) communicating with each other through the heat releasing port (13); an ignition apparatus (10) that is disposed beneath the heat releasing port (13), heat of flaming combustion of combustible gas (2) ignited by the ignition apparatus (10) being supplied to the exhaust passage (4) to raise a temperature of exhaust (6) in the exhaust passage (4); and a flame holding plate (42) that is provided beneath the heat releasing port (13) in a downstream side in the combustible gas supplying passage (8) from the ignition apparatus (10). As illustrated in FIG. 1A, an exhaust guiding plate (46) is provided at a top portion of the flame holding plate (42). The exhaust guiding plate (46) is bent to form an upward slope toward a downstream side in the exhaust passage (4), and the exhaust guiding plate (46) covers the ignition apparatus (10) from diagonally above.

(Invention According to Claim 1)

The invention according to claim 1 provides the following effects.

<<Effect>>

Continuance of combustion flame of combustible gas can be improved.

As illustrated in FIG. 1A, the exhaust guiding plate (46) is provided at the top portion of the flame holding plate (42). The exhaust guiding plate (46) is bent to form an upward slope toward a downstream side in the exhaust passage (4). The exhaust guiding plate (46) covers the ignition apparatus (10) from diagonally above. Therefore, the exhaust (6) passing through the exhaust passage (4) is blocked by the exhaust guiding plate (46). This makes it difficult for the exhaust (6) to enter the area surrounding the ignition apparatus (10) from above the ignition apparatus (10). Accordingly, the combustion flame of the combustible gas (2) is not easily blown off by the exhaust (6), and hence continuance of combustion flame of the combustible gas (2) can be improved.

Further, since the exhaust guiding plate (46) is provided at the top portion of the flame holding plate (42), the developing path of combustion flame becomes longer by the length of the exhaust guiding plate (46). Accordingly, development of combustion flame is facilitated. This also contributes toward improving continuance of combustion flame of the combustible gas (2).

<<Effect>>

An increase in back pressure can be suppressed.

As illustrated in FIG. 1A, since the exhaust guiding plate (46) is bent to form an upward slope toward a downstream side in the exhaust passage (4), the exhaust (6) passing through the exhaust passage (4) is smoothly guided by the exhaust guiding plate (46). Thus, an increase in back pressure can be suppressed.

(Invention According to Claim 2)

The invention according to claim 2 provides the following effect in addition to the effects provided by the invention according to claim 1.

<<Effect>>

Erroneous assembly of the components can be suppressed.

In the improper overlaid state, at least two components out of the overlaid components (52), (47) and (53) are not closely attached to each other. Thus, erroneous assembly of the components can be suppressed. Thus, improper orientation or positioning of the exhaust guiding plate (46) or the gaskets (52) and (53) can be suppressed.

(Invention According to Claim 3)

The invention according to claim 3 provides the following effect in addition to the effect provided by the invention according to claim 2.

<<Effect>>

Erroneous assembly of the components would not possibly occur.

Even when the components are in the proper overlaid state, in the improper clamped state, one of the exhaust upstream side component (50) and the exhaust downstream side component (51), and the components (52), (47), and (53) in the proper overlaid state are not closely attached to each other. Thus, erroneous assembly of the components would not possibly occur. Thus, orientation or positioning of the exhaust guiding plate (46) or the gaskets (52) and (53) becomes proper.

(Invention According to Claim 4)

The invention according to claim 4 provides the following effect in addition to the effects provided by the invention according to claim 2 or 3.

<<Effect>>

Sealability of the liquid sealing-out layer is secured.

As illustrated in FIGS. 1A and 1B, the function of preventing erroneous assembly of the components achieves the following. When the components (52), (47) and (53) in the proper overlaid state are clamped between the exhaust upstream side component (50) and the exhaust downstream side component (51) in the proper clamped state, the liquid sealing-out layer (53*e*) is closely attached to the exhaust downstream side component (51), and a liquefied product of the combustible gas (2) that accumulates in an upstream side in the combustible gas supplying passage (8) from the flame holding plate (42) is sealed out by the liquid sealing-out layer (53*e*). Accordingly, sealability of the liquid sealing-out layer (53*e*) is secured.

(Invention According to Claim 5)

The invention according to claim 5 provides the following effect in addition to the effects provided by the invention according to any of claims 2 to 4.

<<Effect>>

Actuation of the actuation component is secured.

As illustrated in FIGS. 1A and 1B, the function of preventing erroneous assembly of the components achieves the following. When the components (52), (47) and (53) in the proper overlaid state are clamped between the exhaust upstream side component (50) and the exhaust downstream side component (51) in the proper clamped state, as illustrated in FIGS. 3A and 3H, the coupling portions (52*f*) and (53*f*) of the lamination plates are positioned so as to avoid interference with an actuation component (54) provided to the exhaust downstream side component (50). Accordingly, actuation of the actuation component (54) is secured.

(Invention According to Claim 6)

The invention according to claim 6 provides the following effect in addition to the effects provided by the invention according to any of claims 1 to 5.

<<Effect>>

Continuance of combustion flame of combustible gas can be improved.

As illustrated in FIG. 6, since the exhaust gas blocking walls (60) and (60) are formed on the opposite sides of the folding edge (58) of the exhaust guiding plate (46), the exhaust (6) does not enter the area surrounding the ignition apparatus (10) from the opposite sides of the folding edge (58) of the exhaust guiding plate (46), and continuance of combustion flame of the combustible gas (2) can be improved.

BRIEF DESCRIPTION OF THE DRAWINGS

FIGS. 1A to 1C show an exhaust apparatus for a diesel engine according to an embodiment of the present invention, in which FIG. 1A is a vertical cross-sectional diagram of the exhaust treatment apparatus; FIG. 1B is an enlarged view of area B in FIG. 1A; and FIG. 1C is a cross-sectional diagram taken along a line C-C in FIG. 1A;

FIGS. 3A to 3I show overlaid components used for the exhaust treatment apparatus shown in FIGS. 1A to 1C, in which FIG. 3A is a front view of an exhaust downstream side gasket as seen from the exhaust upstream side face; FIG. 3B is an enlarged cross-sectional diagram taken along a line B-B in FIG. 3A; FIG. 3C is an enlarged diagram showing area C in FIG. 3A; FIG. 3D is a cross-sectional diagram taken along a line D-D in FIG. 3A; FIG. 3E is a cross-sectional diagram taken along a line E-E in FIG. 3A; FIG. 3F is a front view of a flame holding plate-equipped component as seen from the exhaust upstream side face; FIG. 3G is a view on arrow G in FIG. 3F; FIG. 3H is a front view of an exhaust upstream side gasket as seen from the exhaust upstream side face; and FIG. 3I is an enlarged cross-sectional diagram taken along a line I-I in FIG. 3H;

DETAILED DESCRIPTION OF PREFERRED EMBODIMENTS

FIGS. 1A to 1C to FIG. 6 are diagrams for describing an exhaust treatment apparatus for an engine according to an embodiment of the present invention. In the present embodiment, a description will be given of an exhaust treatment apparatus for a diesel engine.

Figures 1A, 1B, 1C:
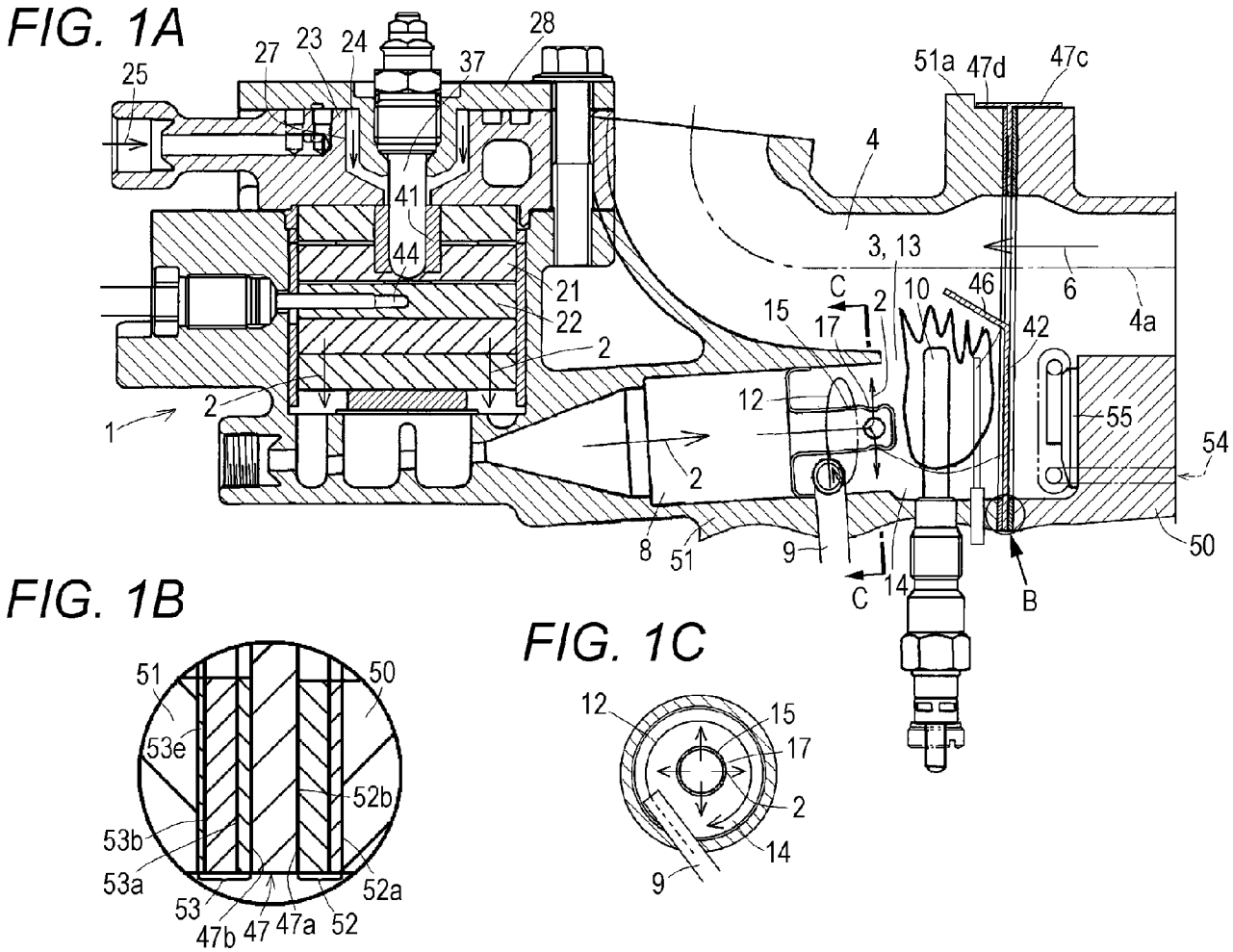
Figure 2:
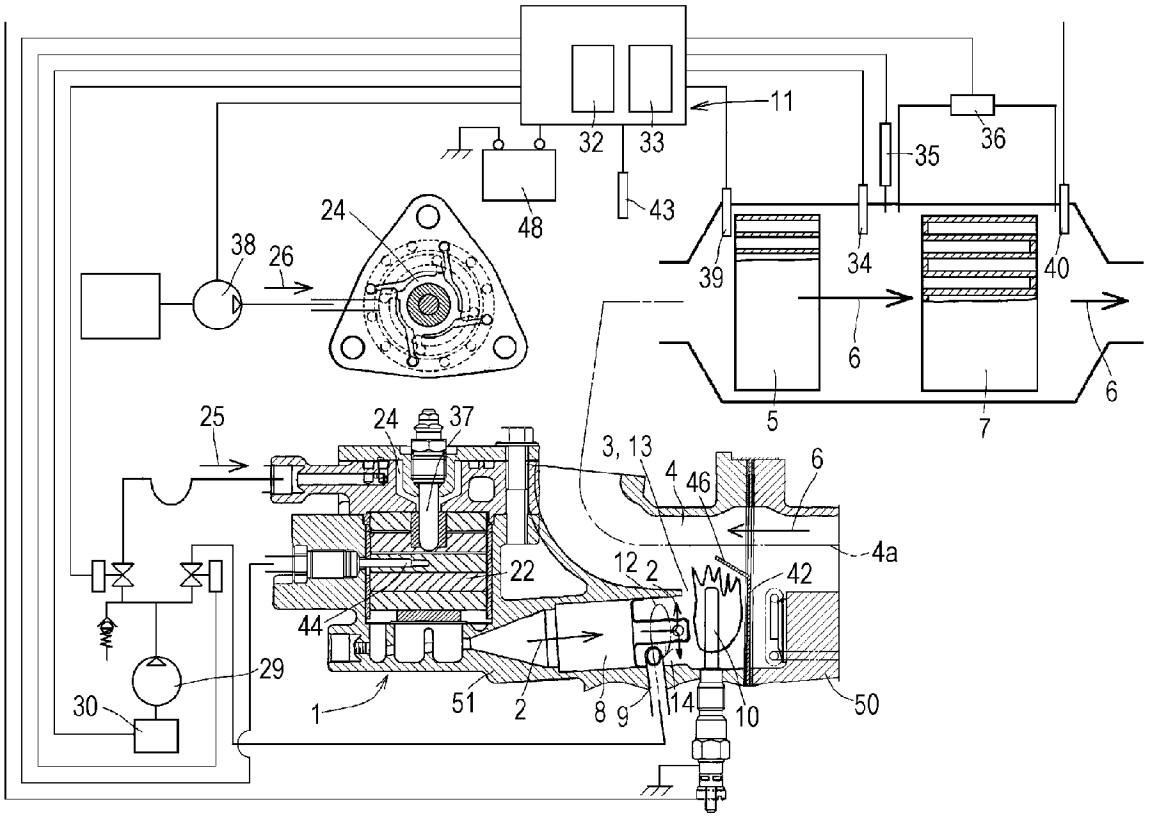
FIG. 2 is a schematic diagram showing the exhaust treatment apparatus shown in FIGS. 1A to 1C and surrounding components.

As shown in FIGS. 1A and 2, an oxidation catalyst (5) disposed in an exhaust passage (4), a combustible gas generator (1), and a combustible gas supplying passage (8) are provided.

The combustible gas supplying passage (8) is provided in parallel to and beneath the exhaust passage (4). A heat releasing port (13) is opened in an upstream side in the exhaust passage (4) from the oxidation catalyst (5) and in a downstream side in the combustible gas supplying passage (8). The exhaust passage (4) and the combustible gas supplying passage (8) communicate with each other through the heat releasing port (13). An ignition apparatus (10) is disposed beneath the heat releasing port (13). The heat of flaming combustion of combustible gas (2) ignited by the ignition apparatus (10) is supplied to the exhaust passage (4) to raise the temperature of exhaust (6) in the exhaust passage (4). A flame holding plate (42) is provided beneath the heat releasing port (13) in a downstream side in the combustible gas supplying passage (8) from the ignition apparatus (10). In the drawing, (4*a*) indicates the center axis line of the exhaust passage (4).

The oxidation catalyst (5) is a DOC (diesel oxidation catalyst), and disposed upstream from a DPF (7). DPF is an abbreviation of diesel particulate filter. In the present embodiment, combustible gas (2) is generated by the combustible gas generator (1), and the combustible gas (2) is discharged from a combustible gas discharging port (3) to the exhaust passage (4). The combustible gas (2) is caused to catalytically combust by the oxidation catalyst (5). The temperature of the exhaust (6) is raised by the heat of catalytic combustion, whereby PM accumulated in the DPF (7) disposed downstream from the oxidation catalyst (5) is removed by combustion. PM is an abbreviation of particulate matter. As the combustible gas discharging port (3), the opening same as the heat releasing port (13) is used.

In addition to or in place of PM removal by the DPF (7), an exhaust purifying catalyst (an SCR catalyst, an $NO_x$ storage catalyst or the like) disposed downstream from the oxidation catalyst (5) may be activated. SCR catalyst is an abbreviation of selective catalytic reduction catalyst.

As the ignition apparatus (10), an electrothermal ignition apparatus is used. Specifically, a glow plug is used.

The flame holding plate (42) suppresses combustion flame from being extinguished by the exhaust (6).

As shown in FIG. 1A, an exhaust guiding plate (46) is provided at the top portion of the flame holding plate (42). The exhaust guiding plate (46) is bent to form an upward slope toward a downstream side in the exhaust passage (4). The exhaust guiding plate (46) covers the ignition apparatus (10) from diagonally above.

As shown in FIG. 1B, a flame holding plate-equipped component (47) equipped with the flame holding plate (42) is fixed by being clamped between an exhaust upstream side component (50) and an exhaust downstream side component (51). An exhaust upstream side gasket (52) is clamped between an exhaust upstream side face (47*a*) of the flame holding plate-equipped component (47) and the exhaust upstream side component (50). An exhaust downstream side gasket (53) is clamped between an exhaust downstream side face (47*b*) of the flame holding plate-equipped component (47) and the exhaust downstream side component (51). The flame holding plate-equipped component (47) is made of sheet metal. The exhaust upstream side component (50) is a casing of a turbocharger, and is a casting. The exhaust downstream side component (51) is a component including the combustible gas generator (1), the combustible gas supplying passage (8), and the midway portion of the exhaust passage (4), and is a casting.

Figures 3A, 3B, 3C, 3D, 3E, 3F, 3G, 3H, 3I:
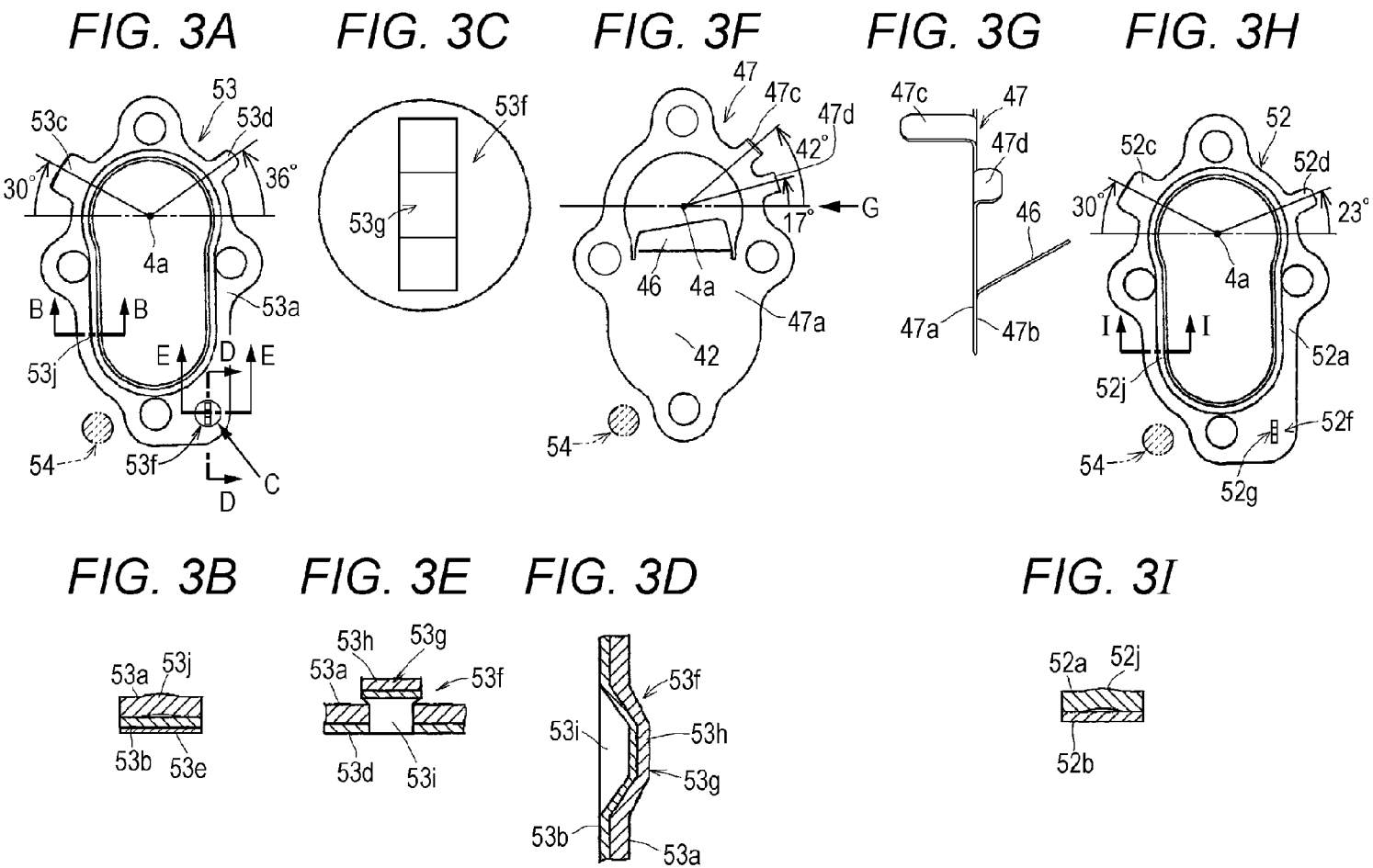

As shown in FIGS. 3A, 3F, and 3H, when the flame holding plate-equipped component (47), the exhaust upstream side gasket (52), and the exhaust downstream side gasket (53) are seen from their respective exhaust upstream side faces (47*a*), (52*a*) and (53*a*), an exhaust upstream side leading piece (47*c*) led out toward the exhaust upstream side and an exhaust downstream side leading piece (47*d*) led out toward the exhaust downstream side are provided on one of right and left sides of the flame holding plate-equipped component (47). Exhaust upstream side engaging pieces (52*c*) and (52*d*) are provided on right and left sides of the exhaust upstream side gasket (52), respectively. Exhaust downstream side engaging pieces (53*c*) and (53*d*) are provided on right and left sides of the exhaust downstream side gasket (53), respectively.

As shown in FIG. 1B, in the proper overlaid state where the exhaust upstream side gasket (52), the flame holding plate-equipped component (47), and the exhaust downstream side gasket (53) are overlaid in this order from the exhaust upstream side having their respective exhaust upstream side faces (52*a*), (47*a*) and (53*a*) oriented in the identical direction, the components (52), (47) and (53) are overlaid as being closely attached to one another.

As shown in FIGS. 3A, 3F, 3G, and 3H, in the improper overlaid state where at least one of the overlaying order of the exhaust upstream side gasket (52), the flame holding plate-equipped component (47), and the exhaust downstream side gasket (53) and the orientation of the components (52), (47) and (53) is different from that in the proper overlaid state, at least one of the exhaust upstream side engaging pieces (52*c*) and (52*d*) and the exhaust downstream side engaging pieces (53*c*) and (53*d*) interfere with at least one of the exhaust upstream side leading piece (47*c*) and the exhaust downstream side leading piece (47*d*), such that at least two components out of the overlaid components (52), (47) and (53) are not closely attached to each other.

As shown in FIG. 3H, as seen from the exhaust upstream side face (52*a*), the exhaust upstream side engaging piece (52*c*) on the left of the exhaust upstream side gasket (52) is wide and projects to the upper left by an elevation angle of 30° with reference to the horizontal line, whereas the right exhaust upstream side engaging piece (52*d*) is narrow and projects to the upper right by an elevation angle of 23° with reference to the horizontal line.

As shown in FIG. 3F, as seen from the exhaust upstream side face (47*a*), the exhaust upstream side leading piece (47*c*) of the flame holding plate-equipped component (47) projects to the upper right by an elevation angle of 42° with reference to the horizontal line, whereas the exhaust downstream side leading piece (47*d*) projects to the upper right by an elevation angle of 17° with reference to the horizontal line.

As shown in FIG. 3A, the exhaust downstream side engaging piece (53*c*) on the left of the exhaust downstream side gasket (53) is wide and projects to upper left by an elevation angle of 30° with reference to the horizontal line, whereas the right exhaust upstream side engaging piece (53*d*) is narrow and projects to upper right by an elevation angle of 36° with reference to the horizontal line.

When only the overlaying order is wrong, i.e., the properly oriented exhaust upstream side gasket (52) is overlaid on the exhaust downstream side from the flame holding plate-equipped component (47), the exhaust upstream side engaging piece (52*d*) on the right of the exhaust upstream side gasket (52) interferes with the exhaust downstream side leading piece (47*d*) of the flame holding plate-equipped component (47). Thus, the exhaust upstream side gasket (52) and the adjacent component are not closely attached to each other. Further, when the properly oriented exhaust downstream side gasket (53) is overlaid on the exhaust upstream side from the flame holding plate-equipped component (47), the exhaust downstream side engaging piece (53*d*) on the right of the exhaust downstream side gasket (53) interferes with the exhaust upstream side leading piece (47*c*) of the flame holding plate-equipped component (47). Thus, the exhaust downstream side gasket (53) and the adjacent component are not closely attached to each other.

When both the overlaying order and orientation are wrong, i.e., the exhaust upstream side gasket (52) whose exhaust upstream side face (52*a*) is oriented toward the exhaust downstream side is overlaid on the exhaust downstream side from the flame holding plate-equipped component (47), the exhaust upstream side engaging piece (52*c*) on the left of the exhaust upstream side gasket (52) flips to the right and interferes with the exhaust downstream side leading piece (47*d*) of the flame holding plate-equipped component (47). Thus, the exhaust upstream side gasket (52) and the adjacent component are not closely attached to each other. Further, when the exhaust downstream side gasket (53) whose exhaust upstream side face (53*a*) is oriented toward the exhaust downstream side is overlaid on the exhaust upstream side from the flame holding plate-equipped component (47), the exhaust downstream side engaging piece (53*c*) on the left of the exhaust downstream side gasket (53) flips to the right and interferes with the exhaust upstream side leading piece (47*c*) of the flame holding plate-equipped component (47). Thus, the exhaust downstream side gasket (53) and the adjacent component are not closely attached to each other.

As shown in FIG. 1A, an engaging portion (51*a*) is provided to one of the exhaust upstream side component (50) and the exhaust downstream side component (51).

As shown in FIG. 1B, in the proper clamped state where the components (52), (47), and (53) in the proper overlaid state are clamped between the exhaust upstream side component (50) and the exhaust downstream side component (51) as being properly oriented, the components (50) and (51) and the components (52), (47), and (53) in the proper overlaid state are closely attached to each other.

As shown in FIGS. 1A and 1B, even when the components (52), (47), and (53) are in the proper overlaid state, when they are in the improper clamped state where they are clamped between the exhaust upstream side component (50) and the exhaust downstream side component (51) as being improperly oriented, one of the exhaust upstream side leading piece (47*c*) and the exhaust downstream side leading piece (47*d*) interferes with the engaging portion (51*a*) provided to one of the exhaust upstream side component (50) and the exhaust downstream side component (51). Thus, one of the components (50) and (51) and the components (52), (47), and (53) in the proper overlaid state are not closely attached to each other.

In the present embodiment, in the improper clamped state, the exhaust upstream side leading piece (47*c*) interferes with the engaging portion (51*a*) provided to the exhaust downstream side component (51), and thus the exhaust downstream side component (51) and the components (52), (47), and (53) in the proper overlaid state are not closely attached to each other.

As shown in FIGS. 1A and 1B, out of the exhaust upstream side face (52*a*) and the exhaust downstream side face (52*b*) of the exhaust upstream side gasket (52), and the exhaust upstream side face (53*a*) and the exhaust downstream side face (53*b*) of the exhaust downstream side gasket (53), a liquid sealing-out layer (53*e*) is provided only to the exhaust downstream side face (53*b*) of the exhaust downstream side gasket (53). Thus, as shown in FIG. 1B, in the proper clamped state where the components (52), (47), and (53) in the proper overlaid state are clamped between the exhaust upstream side component (50) and the exhaust downstream side component (51) as being properly oriented, the liquid sealing-out layer (53*e*) is closely attached to the exhaust downstream side component (51), and a liquefied product of the combustible gas (2) that accumulates in the combustible gas supplying passage (8) in the upstream side from the flame holding plate (42) is sealed out by the liquid sealing-out layer (53*e*). For the liquid sealing-out layer (53*e*), a heat-resistant fluorine-based resin coating material is used.

As shown in FIG. 1B, the exhaust upstream side gasket (52) and the exhaust downstream side gasket (53) are each made of a lamination plate. As shown in FIGS. 3A and 3H, coupling portions (52*f*) and (53*f*) of the lamination plates are provided to only one of right and left sides of the gaskets (52) and (53), respectively. As shown in FIG. 1B, in the proper clamped state where the components (52), (47), and (53) in the proper overlaid state are clamped between the exhaust upstream side component (50) and the exhaust downstream side component (51) as being properly oriented, each of the coupling portions (52*f*) and (53*f*) of the lamination plates are positioned so as to avoid interference with an actuation component (54) provided to the exhaust downstream side component (50).

In the present embodiment, as seen from the exhaust upstream side faces (52*a*) and (53*a*), the coupling portions (52*f*) and (53*f*) are provided only on the right side of the exhaust upstream side gasket (52) and the exhaust downstream side gasket (53), respectively. The coupling portions (52*f*) and (53*f*) are provided with engaging portions (52*g*) and (53*g*), each of which is part of the lamination plate being pushed out toward the exhaust upstream side. The two lamination plates are integrally coupled to each other by the engaging portions (52*g*) and (53*g*). The actuation component (54) is an interlock device of the wastegate valve of the turbocharger.

As shown in FIGS. 3C, 3D, and 3E, the engaging portion (53*g*) of the exhaust downstream side gasket (53) is formed by punching out part of the lamination plate to the exhaust upstream side when the lamination plate is subjected to punching work performed with a press machine, and flattening the punched-out end (53*h*) to be widened, such that the punched-out end (53*h*) is prevented from coming off from a punched hole (53*i*). The engaging portion (52*g*) shown in FIG. 3H is in a similar structure.

Further, as shown in FIGS. 3B and 3I, out of the exhaust upstream side faces (52*a*) and (53*a*) and the exhaust downstream side faces (52*b*) and (53*b*) of the exhaust upstream side gasket (52) and the exhaust downstream side gasket (53), only the exhaust upstream side faces (52*a*) and (53*a*) are provided with beads (52*j*) and (53*j*), respectively. The beads (52*j*) and (53*j*) project toward the exhaust upstream side.

Figure 6:
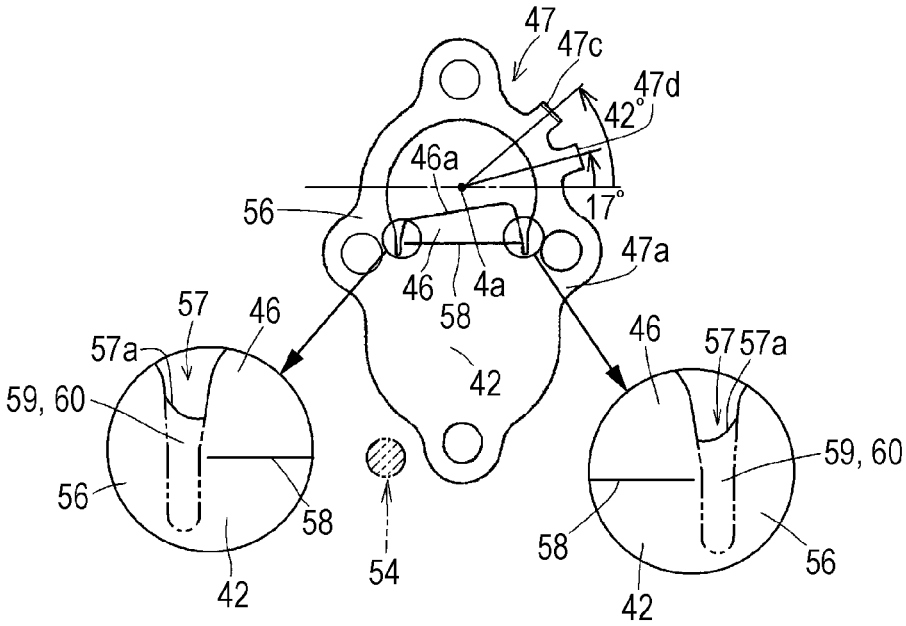
FIG. 6 is a diagram showing a variation of the flame holding plate-equipped component corresponding to FIG. 3F.

FIG. 6 shows a variation of the flame holding plate-equipped component.

The flame holding plate-equipped component (47) is equipped with the flame holding plate (42) at a supporting portion (56). The supporting portion (56) is fixed by being clamped between the exhaust upstream side component (50) and the exhaust downstream side component (51). Cuttings (57) and (57) are provided between the supporting portion (56) and the exhaust guiding plate (46) from a folding end (46*a*) side of the exhaust guiding plate (46) toward a folding edge (58) side. Cutting ends (57*a*) and (57*a*) of the cuttings (57) and (57) are ended before the opposite sides of the folding edge (58) of the exhaust guiding plate (46). The exhaust guiding plate (46) is folded at the folding edge (58) while leaving walls (59) and (59) on the opposite sides of the folding edge (58) of the exhaust guiding plate (46). Thus, exhaust gas blocking walls (60) and (60) are formed on the opposite sides of the folding edge (58) of the exhaust guiding plate (46).

Other structures are identical to those of the flame holding plate-equipped component (47) shown in FIG. 3F. In FIG. 6, the elements identical to those of the flame holding plate-equipped component (47) shown in FIG. 3F are denoted by the identical reference characters as in FIG. 3F.

The DPF (7) is regenerated in the following manner.

As shown in FIG. 2, the ignition apparatus (10) is associated with a power supply (48) by a control apparatus (11).

The control apparatus (11) is an engine ECU. ECU is an abbreviation of electronic control unit. The power supply (48) is a battery.

Figure 4:
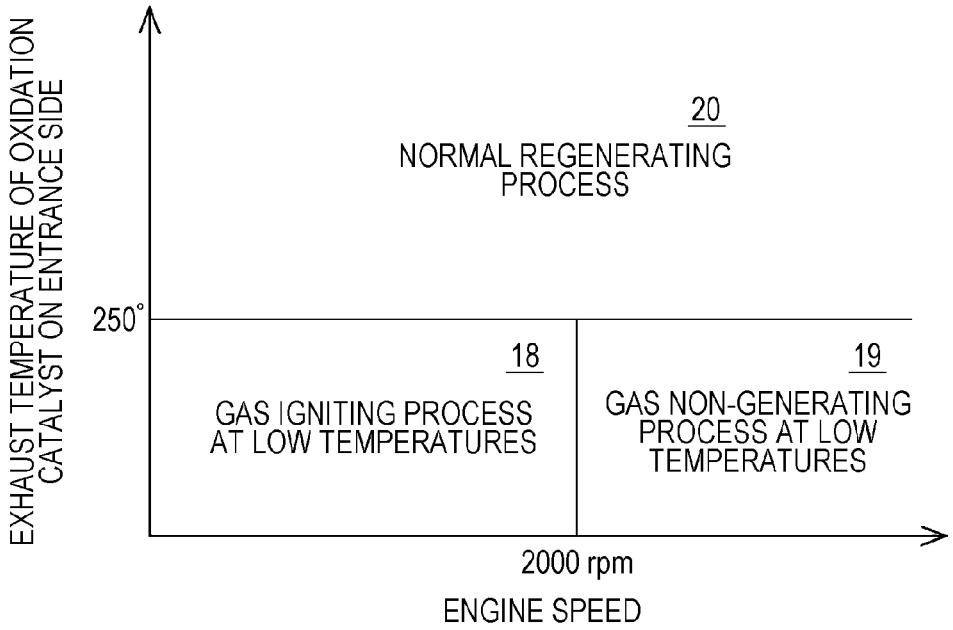
FIG. 4 is an explanatory diagram showing the process regions of the exhaust treatment apparatus shown in FIGS. 1A to 1C.

When the PM combustion removal starting condition is satisfied (when the estimated PM accumulation value has reached the regeneration start value) or when the exhaust purifying catalyst activation starting condition is satisfied, the control apparatus (11) performs any of the processes shown in FIG. 4, in accordance with the exhaust temperature and the engine speed.

Figure 5:
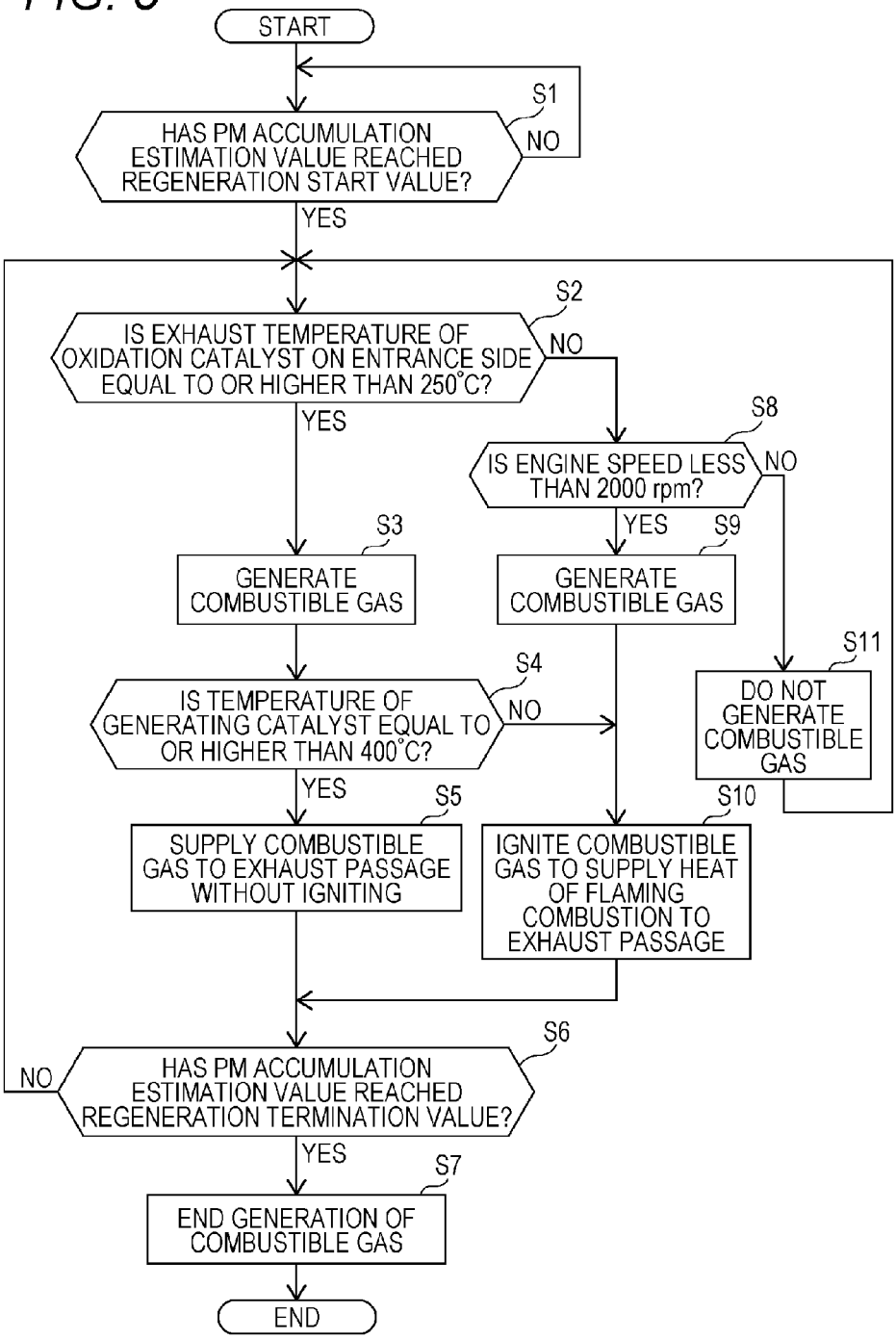
FIG. 5 is a flowchart of DPF regeneration carried out by the exhaust treatment apparatus shown in FIGS. 1A to 1C.

As shown in FIG. 4, based on the control apparatus (11) detecting that the exhaust temperature is less than a prescribed value (specifically, the exhaust temperature at the entrance of the oxidation catalyst is less than 250° C.) and the engine speed is less than a prescribed value (specifically, less than 2000 rpm), the control apparatus (11) executes a gas igniting process at low temperatures (18). In the gas igniting process at low temperatures (18), as shown in FIG. 5, the combustible gas generator (1) is allowed to generate the combustible gas (2) (S9); and the ignition apparatus (10) ignites the combustible gas (2) and the heat of flaming combustion of the combustible gas (2) is supplied to the exhaust passage (4) (S10).

Thus, even in the case where the exhaust temperature does not intrinsically reach the activation temperature of the oxidation catalyst (5), e.g., immediately after the engine startup or in the light-load driving mode, it becomes possible to raise the temperature of the exhaust (6) by the heat of flaming combustion of the combustible gas (2) and to cause the exhaust temperature to reach the activation temperature of the oxidation catalyst (5). Accordingly, even immediately after the engine startup or in the light-load driving mode, the PM accumulated in the DPF (7) can be combusted, or the exhaust purifying catalyst can be activated. Here, 250° C. is the activation temperature of the oxidation catalyst (5).

As shown in FIG. 4, based on the control apparatus (11) detecting that the exhaust temperature is less than a prescribed value (specifically, the exhaust temperature at the entrance of the DOC is less than 250° C.) and the engine speed is equal to or higher than a prescribed value (specifically, 2000 rpm or more), the control apparatus (11) executes a gas non-generating process at low temperatures (19). In the gas non-generating process at low temperatures (19), as shown in FIG. 5, the combustible gas generator (1) is not allowed to generate the combustible gas (2). Thus, the combustible gas (2) can be prevented from being wastefully generated in the low-temperature high-speed mode where it is difficult to maintain the combustion flame of the combustible gas (2).

As shown in FIG. 4, based on the control apparatus (11) detecting that the exhaust temperature is equal to or higher than a prescribed value (specifically, the exhaust temperature at the entrance of the DOC is 250° C. or more), the control apparatus (11) executes a normal regenerating process (20). In the normal regenerating process (20), as shown in FIG. 5, the combustible gas (2) is generated (S3), and the combustible gas (2) is supplied to the exhaust passage (4) without being ignited (S5).

As shown in FIG. 1C, an air supplying apparatus (9) is provided at the combustible gas supplying passage (8), and the air supplying apparatus (9) is associated with the control apparatus (10). When the gas igniting process at low temperatures (18) is executed, air (12) is supplied to the combustible gas (2). The air supplying apparatus (9) is an air supplying pipe.

That is, as shown in FIGS. 1A and 1C, a mixing chamber (14) of the combustible gas (2) and the air (12) is formed along the combustible gas supplying passage (8) in the upstream from the ignition apparatus (10). A combustible gas nozzle (15) and the air supplying apparatus (9) are provided in this mixing chamber (14). The combustible gas nozzle (15) is disposed at the center portion of the mixing chamber (14) along the direction in which the mixing chamber (14) is formed. A plurality of combustible gas outlets (17) are formed at the circumferential face of the combustible gas nozzle (15). The air supplying apparatus (9) is disposed at the inner circumferential face portion of the mixing chamber (14) in the direction along the circumferential direction of the inner circumferential face of the mixing chamber (14). When the combustible gas (2) supplied from the ignition apparatus (10) is ignited and during flaming combustion, the air (12) supplied from the air supplying apparatus (9) is caused to whirl along the inner circumferential face of the mixing chamber (14) around the combustible gas nozzle (15).

The whirling air (12) is mixed with the combustible gas (2) supplied from the combustible gas outlets (17) in the radial direction of the mixing chamber (14). Thus, ignition and flaming combustion of the combustible gas (2) are facilitated, whereby a great amount of released heat can be obtained from the combustible gas (2).

As shown in FIG. 2, in generating the combustible gas (2) by a combustible gas generating catalyst (22) by supplying liquid fuel (26) and air (25) to the combustible gas generator (1), when the temperature of the combustible gas generating catalyst (22) is lower than a prescribed temperature (specifically, less than 400° C.), the control apparatus (11) causes the air supplying apparatus (9) to supply the combustible gas (2) with the air (25). Thus, as shown in FIG. 5, the combustible gas (2) is ignited by the ignition apparatus (10) and the heat of flaming combustion of the combustible gas (2) is supplied to the exhaust passage (4) (S10). The heat of flaming combustion vaporizes the liquid component flown out from the combustible gas generator (1). Thus, the liquid component flown out from the combustible gas generator (1) will not attach inside the exhaust passage (4), and hence white smoke is prevented from being produced upon startup of the engine.

As shown in FIG. 1A, the combustible gas generator (1) is provided with a combustible gas generating catalyst chamber (21). The combustible gas generating catalyst (22) is stored in the combustible gas generating catalyst chamber (21). An annular wall (23) is disposed at the leading end of the combustible gas generating catalyst chamber (21). On the inner side of the annular wall (23), an air-fuel mixing chamber (24) is formed. Supplying the air (25) and the liquid fuel (26) into the air-fuel mixing chamber (24), an air-fuel mixture gas (27) is formed in the air-fuel mixing chamber (24). This air-fuel mixture gas (27) is supplied to the combustible gas generating catalyst (22), such that the combustible gas (2) is generated by the combustible gas generating catalyst (22). The air-fuel mixing chamber (24) has a lid (28).

The liquid fuel (26) is light oil. The combustible gas generating catalyst (22) is an oxidation catalyst.

Part of the liquid fuel (26) is catalytically combusted by the combustible gas generating catalyst (22). The remainder of the liquid fuel (26) is vaporized by the heat of catalytic combustion, to obtain the combustible gas (2).

The DPF regeneration is controlled in the following manner.

The control apparatus (11) shown in FIG. 2 includes a PM accumulation amount estimating apparatus (32) and a PM regenerating control apparatus (33). The PM accumulation amount estimating apparatus (32) is a prescribed calculation unit of the engine ECU (31). The PM accumulation amount estimating apparatus (32) estimates the PM accumulation amount from map data that is previously empirically obtained based on the engine load, the engine speed, the exhaust temperature detected by a DPF upstream side exhaust temperature sensor (34), the exhaust pressure on the upstream side of the DPF (7) detected by a DPF upstream side exhaust pressure sensor (35), the differential pressure between an upstream and a downstream with reference to the DPF (7) detected by a differential pressure sensor (36).

When the PM accumulation amount estimation value at the PM accumulation amount estimating apparatus (32) has reached a prescribed regeneration start value, the PM regenerating control apparatus (33) causes a heater (37) to emit heat, and drives a liquid fuel pump (38) and a motor (30) of a blower (29). Thus, the air-fuel mixing chamber (24) is supplied with the liquid fuel (26) and the air (25). Then, as shown in FIG. 1A, the air-fuel mixture gas (27) is formed, and the combustible gas (2) is generated by the combustible gas generating catalyst (22). The heater (37) is surrounded by an activation catalyst (41) that can retain liquid fuel. The supply of heat from the heater (37) is focused on the liquid fuel retained by the activation catalyst (41). Thus, generation of the combustible gas (2) is quickly started.

At the initial stage of starting generation of the combustible gas (2), the heater (37) is caused to emit heat for a prescribed time. When the generation of the combustible gas (2) has started, the temperature of the combustible gas generating catalyst (13) rises by a heat reaction. Accordingly, when a prescribed time has elapsed since the start of generation of the combustible gas (2), heat emission of the heater (37) is stopped using a timer.

The PM regenerating control apparatus (33) is associated with an entrance side temperature sensor (39) of the oxidation catalyst (5), an engine speed sensor (43), and a catalyst temperature sensor (44) of the combustible gas generating catalyst (22), and performs the processes corresponding to the process regions shown in FIG. 4.

The PM regenerating control apparatus (33) is associated with an exit side temperature sensor (40) of the DPF (7). When the temperature on the exit side of the DPF (7) is abnormally high, the regeneration is immediately stopped.

The flow of the DPF regeneration is as follows.

As shown in FIG. 5, whether or not the PM accumulation estimation value has reached the regeneration start value is determined in Step (S1). When the determination result is YES, whether or not the exhaust temperature on the entrance side of the oxidation catalyst (5) is 250° C. or more is determined in Step (S2). When the determination result is YES, the combustible gas (2) is generated in Step (S3). In Step (S4), whether or not the temperature of the combustible gas generating catalyst (22) is 400° C. or more is determined. When the determination result is YES, the combustible gas (2) is not ignited and supplied to the exhaust passage (4) in Step (S5). In Step (S6), whether or not the PM accumulation estimation value has reached a regeneration termination value is determined. When the determination result is YES, the combustible gas generation ends in Step (S7), and thus the regeneration of the DPF ends.

When the determination result in Step (S6) is NO, control returns to Step (S2).

When the determination result in Step (S2) is NO, whether or not the engine speed is less than 2000 rpm is determined in Step (S8). When the determination result is YES, the combustible gas (2) is generated in Step (S9); the combustible gas (2) is ignited in Step (S10); the heat of the flaming combustion is supplied to the exhaust passage (4); and control proceeds to Step (S6). When the determination in Step (S4) is NO also, control proceeds to Step (S10).

When the determination result in Step (S8) is NO, the combustible gas is not generated in Step (S11), and control returns to Step (S2).

In the present embodiment, the process may be executed in the following manner.

When the temperature of the exhaust (6) is less than a prescribed reference temperature during regeneration of the DPF (7), the control apparatus (11) executes the gas igniting process at low temperatures. In the gas igniting process at low temperatures, the ignition apparatus (10) ignites the combustible gas (2), and the heat of flaming combustion of the combustible gas (2) is supplied to the exhaust passage (4).

When a prescribed amount of PM has accumulated at the oxidation catalyst (5), the control apparatus (11) executes a process of regenerating the oxidation catalyst (5). In this process of regenerating the oxidation catalyst (5), the combustible gas generator (1) is allowed to generate the combustible gas (2); the ignition apparatus (10) ignites the combustible gas (2); and the heat of flaming combustion of the combustible gas (2) is supplied to the exhaust passage (4), such that the exhaust temperature at the entrance of the oxidation catalyst (5) becomes higher than that in the gas igniting process at low temperatures. Thus, the PM accumulated at the oxidation catalyst (5) is removed by combustion.

In the gas igniting process at low temperatures, as the temperature of the exhaust (6) is lower and as the engine speed is higher, the control apparatus (11) sets a higher voltage to be applied to the ignition apparatus (10). Further, as the ambient temperature of the ignition apparatus (10) is higher, the control apparatus (11) lowers such a set voltage by a greater degree. Thus, thermal damage to the ignition apparatus (10) is suppressed.

Further, also when the oxidation catalyst (5) is regenerated, similar voltage management of the ignition apparatus (10) is performed.

The control apparatus (11) is associated with a sensor (not shown) for detecting the ambient temperature of the ignition apparatus (10) and a sensor (not shown) for detecting the exhaust pressure on the upstream side of the oxidation catalyst (5). Thus, accumulation of PM at the oxidation catalyst (5) and the ambient temperature of the ignition apparatus (10) can be detected.

What is claimed is:

1. An exhaust treatment apparatus for an engine, comprising:

an exhaust passage;

an oxidation catalyst that is disposed in the exhaust passage;

a combustible gas generator;

a combustible gas supplying passage that is disposed in parallel to and beneath the exhaust passage;

a heat releasing port that is opened in an upstream side in the exhaust passage from the oxidation catalyst and in a downstream side in the combustible gas supplying passage, the exhaust passage and the combustible gas supplying passage communicating with each other through the heat releasing port;

an ignition apparatus that is disposed beneath the heat releasing port, heat of flaming combustion of combustible gas ignited by the ignition apparatus being supplied to the exhaust passage to raise a temperature of exhaust in the exhaust passage; and a flame holding plate that is provided beneath the heat releasing port in a downstream side in the combustible gas supplying passage from the ignition apparatus, wherein an exhaust guiding plate is provided at a top portion of the flame holding plate, the exhaust guiding plate is bent to form an upward slope toward a downstream side in the exhaust passage, and the exhaust guiding plate covers the ignition apparatus from diagonally above, a flame holding plate-equipped component that is equipped with the flame holding plate, the flame holding plate-equipped component being fixed by being clamped between an exhaust upstream side component and an exhaust downstream side component;

an exhaust upstream side gasket that is clamped between an exhaust upstream side face of the flame holding plate-equipped component and the exhaust upstream side component; and an exhaust downstream side gasket that is clamped between an exhaust downstream side face of the flame holding plate-equipped component and the exhaust downstream side component, wherein when the flame holding plate-equipped component, the exhaust upstream side gasket, and the exhaust downstream side gasket are seen from their respective exhaust upstream side faces, an exhaust upstream side leading piece that is led out toward an exhaust upstream side and an exhaust downstream side leading piece that is led out toward an exhaust downstream side are provided on one of right and left sides of the flame holding plate-equipped component, wherein exhaust upstream side engaging pieces are provided on right and left sides of the exhaust upstream side gasket, respectively, exhaust downstream side engaging pieces are provided on right and left sides of the exhaust downstream side gasket, respectively, in a proper overlaid state where the exhaust upstream side gasket, the flame holding plate-equipped component, and the exhaust downstream side gasket are overlaid in this order from an exhaust upstream side having their respective exhaust upstream side faces oriented in an identical direction, the components are overlaid as being closely attached to one another, and in an improper overlaid state where at least one of an overlaying order of the exhaust upstream side gasket, the flame holding plate-equipped component, and the exhaust downstream side gasket and an orientation of the components is different from that in the proper overlaid state, wherein at least one of the exhaust upstream side engaging pieces and the exhaust downstream side engaging pieces interfere with at least one of the exhaust upstream side leading piece and the exhaust downstream side leading piece, such that at least two components out of the overlaid components are not closely attached to each other.

2. The exhaust treatment apparatus for an engine according to claim 1, further comprising an engaging portion that is provided to one of the exhaust upstream side component and the exhaust downstream side component, wherein in a proper clamped state where the components in the proper overlaid state are clamped between the exhaust upstream side component and the exhaust downstream side component as being properly oriented, the components and the components in the proper overlaid state are closely attached to each other, and even when the components are in the proper overlaid state, when the components are in an improper clamped state where the components are clamped between the exhaust upstream side component and the exhaust downstream side component as being improperly oriented, one of the exhaust upstream side leading piece and the exhaust downstream side leading piece interferes with the engaging portion provided to one of the exhaust upstream side component and the exhaust downstream side component, such that one of the components and the components in the proper overlaid state are not closely attached to each other.

3. The exhaust treatment apparatus for an engine according to claim 1, wherein out of the exhaust upstream side face and the exhaust downstream side face of the exhaust upstream side gasket, and the exhaust upstream side face and the exhaust downstream side face of the exhaust downstream side gasket, a liquid sealing-out layer is provided only to the exhaust downstream side face of the exhaust downstream side gasket, in a proper clamped state where the components in the proper overlaid state are clamped between the exhaust upstream side component and the exhaust downstream side component as being properly oriented, the liquid sealing-out layer is closely attached to the exhaust downstream side component, and a liquefied product of the combustible gas that accumulates in an upstream side in the combustible gas supplying passage from the flame holding plate is sealed out by the liquid sealing-out layer.

4. The exhaust treatment apparatus for an engine according to claim 2, wherein out of the exhaust upstream side face and the exhaust downstream side face of the exhaust upstream side gasket, and the exhaust upstream side face and the exhaust downstream side face of the exhaust downstream side gasket, a liquid sealing-out layer is provided only to the exhaust downstream side face of the exhaust downstream side gasket, in the proper clamped state where the components in the proper overlaid state are clamped between the exhaust upstream side component and the exhaust downstream side component as being properly oriented, the liquid sealing-out layer is closely attached to the exhaust downstream side component, and a liquefied product of the combustible gas that accumulates in an upstream side in the combustible gas supplying passage from the flame holding plate is sealed out by the liquid sealing-out layer.

5. The exhaust treatment apparatus for an engine according to claim 1, wherein the exhaust upstream side gasket and the exhaust downstream side gasket are each made of a lamination plate, coupling portions of the lamination plates are provided to only one of right and left sides of the gaskets, respectively, and in a proper clamped state where the components in the proper overlaid state are clamped between the exhaust upstream side component and the exhaust downstream side component as being properly oriented, each of the coupling portions of the lamination plates are positioned so as to avoid interference with an actuation component provided to the exhaust downstream side component.

6. The exhaust treatment apparatus for an engine according to claim 2, wherein the exhaust upstream side gasket and the exhaust downstream side gasket are each made of a lamination plate, coupling portions of the lamination plates are provided to only one of right and left sides of the gaskets, respectively, and in the proper clamped state where the components in the proper overlaid state are clamped between the exhaust upstream side component and the exhaust downstream side component as being properly oriented, each of the coupling portions of the lamination plates are positioned so as to avoid interference with an actuation component provided to the exhaust downstream side component.

7. The exhaust treatment apparatus for an engine according to claim 3, wherein the exhaust upstream side gasket and the exhaust downstream side gasket are each made of a lamination plate, coupling portions of the lamination plates are provided to only one of right and left sides of the gaskets, respectively, and in the proper clamped state where the components in the proper overlaid state are clamped between the exhaust upstream side component and the exhaust downstream side component as being properly oriented, each of the coupling portions of the lamination plates are positioned so as to avoid interference with an actuation component provided to the exhaust downstream side component.

8. The exhaust treatment apparatus for an engine according to claim 4, wherein the exhaust upstream side gasket and the exhaust downstream side gasket are each made of a lamination plate, coupling portions of the lamination plates are provided to only one of right and left sides of the gaskets, respectively, and in the proper clamped state where the components in the proper overlaid state are clamped between the exhaust upstream side component and the exhaust downstream side component as being properly oriented, each of the coupling portions of the lamination plates are positioned so as to avoid interference with an actuation component provided to the exhaust downstream side component.

9. An exhaust treatment apparatus for an engine, comprising:

an exhaust passage;

an oxidation catalyst that is disposed in the exhaust passage;

a combustible gas generator;

a combustible gas supplying passage that is disposed in parallel to and beneath the exhaust passage;

a heat releasing port that is opened in an upstream side in the exhaust passage from the oxidation catalyst and in a downstream side in the combustible gas supplying passage, the exhaust passage and the combustible gas supplying passage communicating with each other through the heat releasing port;

an ignition apparatus that is disposed beneath the heat releasing port, heat of flaming combustion of combustible gas ignited by the ignition apparatus being supplied to the exhaust passage to raise a temperature of exhaust in the exhaust passage; and a flame holding plate that is provided beneath the heat releasing port in a downstream side in the combustible gas supplying passage from the ignition apparatus, wherein an exhaust guiding plate is provided at a top portion of the flame holding plate, the exhaust guiding plate is bent to form an upward slope toward a downstream side in the exhaust passage, the exhaust guiding plate covers the ignition apparatus from diagonally above, a flame holding plate-equipped component equipped with the flame holding plate at a supporting portion is provided, wherein the supporting portion is fixed by being clamped between an exhaust upstream side component and an exhaust downstream side component, cuttings are provided between the supporting portion and the exhaust guiding plate from a folding end side of the exhaust guiding plate toward a folding edge side, cutting ends of the cuttings are ended before opposite sides of the folding edge of the exhaust guiding plate, and the exhaust guiding plate is folded at the folding edge while leaving walls on opposite sides of the folding edge of the exhaust guiding plate, so as to form exhaust gas blocking walls on the opposite sides of the folding edge of the exhaust guiding plate.

10. The exhaust treatment apparatus for an engine according to claim 1, wherein the flame holding plate-equipped component equipped with the flame holding plate at a supporting portion is provided, the supporting portion is fixed by being clamped between the exhaust upstream side component and the exhaust downstream side component, cuttings are provided between the supporting portion and the exhaust guiding plate from a folding end side of the exhaust guiding plate toward a folding edge side, cutting ends of the cuttings are ended before opposite sides of the folding edge of the exhaust guiding plate, and the exhaust guiding plate is folded at the folding edge while leaving walls on opposite sides of the folding edge of the exhaust guiding plate, so as to form exhaust gas blocking walls on the opposite sides of the folding edge of the exhaust guiding plate.

11. The exhaust treatment apparatus for an engine according to claim 2, wherein the flame holding plate-equipped component equipped with the flame holding plate at a supporting portion is provided, the supporting portion is fixed by being clamped between the exhaust upstream side component and the exhaust downstream side component, cuttings are provided between the supporting portion and the exhaust guiding plate from a folding end side of the exhaust guiding plate toward a folding edge side, cutting ends of the cuttings are ended before opposite sides of the folding edge of the exhaust guiding plate, and the exhaust guiding plate is folded at the folding edge while leaving walls on opposite sides of the folding edge of the exhaust guiding plate, so as to form exhaust gas blocking walls on the opposite sides of the folding edge of the exhaust guiding plate.

12. The exhaust treatment apparatus for an engine according to claim 3, wherein the flame holding plate-equipped component equipped with the flame holding plate at a supporting portion is provided, the supporting portion is fixed by being clamped between the exhaust upstream side component and the exhaust downstream side component, cuttings are provided between the supporting portion and the exhaust guiding plate from a folding end side of the exhaust guiding plate toward a folding edge side, cutting ends of the cuttings are ended before opposite sides of the folding edge of the exhaust guiding plate, and the exhaust guiding plate is folded at the folding edge while leaving walls on opposite sides of the folding edge of the exhaust guiding plate, so as to form exhaust gas blocking walls on the opposite sides of the folding edge of the exhaust guiding plate.

13. The exhaust treatment apparatus for an engine according to claim 4, wherein the flame holding plate-equipped component equipped with the flame holding plate at a supporting portion is provided, the supporting portion is fixed by being clamped between the exhaust upstream side component and the exhaust downstream side component, cuttings are provided between the supporting portion and the exhaust guiding plate from a folding end side of the exhaust guiding plate toward a folding edge side, cutting ends of the cuttings are ended before opposite sides of the folding edge of the exhaust guiding plate, and the exhaust guiding plate is folded at the folding edge while leaving walls on opposite sides of the folding edge of the exhaust guiding plate, so as to form exhaust gas blocking walls on the opposite sides of the folding edge of the exhaust guiding plate.

14. The exhaust treatment apparatus for an engine according to claim 5, wherein the flame holding plate-equipped component equipped with the flame holding plate at a supporting portion is provided, the supporting portion is fixed by being clamped between the exhaust upstream side component and the exhaust downstream side component, cuttings are provided between the supporting portion and the exhaust guiding plate from a folding end side of the exhaust guiding plate toward a folding edge side, cutting ends of the cuttings are ended before opposite sides of the folding edge of the exhaust guiding plate, and the exhaust guiding plate is folded at the folding edge while leaving walls on opposite sides of the folding edge of the exhaust guiding plate so as to form exhaust gas blocking walls on the opposite sides of the folding edge of the exhaust guiding plate.

15. The exhaust treatment apparatus for an engine according to claim 6, wherein the flame holding plate-equipped component equipped with the flame holding plate at a supporting portion is provided, the supporting portion is fixed by being clamped between the exhaust upstream side component and the exhaust downstream side component, cuttings are provided between the supporting portion and the exhaust guiding plate from a folding end side of the exhaust guiding plate toward a folding edge side, cutting ends of the cuttings are ended before opposite sides of the folding edge of the exhaust guiding plate, and the exhaust guiding plate is folded at the folding edge while leaving walls on opposite sides of the folding edge of the exhaust guiding plate, so as to form exhaust gas blocking walls on the opposite sides of the folding edge of the exhaust guiding plate.

16. The exhaust treatment apparatus for an engine according to claim 7, wherein the flame holding plate-equipped component equipped with the flame holding plate at a supporting portion is provided, the supporting portion is fixed by being clamped between the exhaust upstream side component and the exhaust downstream side component, cuttings are provided between the supporting portion and the exhaust guiding plate from a folding end side of the exhaust guiding plate toward a folding edge side, cutting ends of the cuttings are ended before opposite sides of the folding edge of the exhaust guiding plate, and the exhaust guiding plate is folded at the folding edge while leaving walls on opposite sides of the folding edge of the exhaust guiding plate, so as to form exhaust gas blocking walls on the opposite sides of the folding edge of the exhaust guiding plate.

17. The exhaust treatment apparatus for an engine according to claim 8, wherein the flame holding plate-equipped component equipped with the flame holding plate at a supporting portion is provided, the supporting portion is fixed by being clamped between the exhaust upstream side component and the exhaust downstream side component, cuttings are provided between the supporting portion and the exhaust guiding plate from a folding end side of the exhaust guiding plate toward a folding edge side, cutting ends of the cuttings are ended before opposite sides of the folding edge of the exhaust guiding plate, and the exhaust guiding plate is folded at the folding edge while leaving walls on opposite sides of the folding edge of the exhaust guiding plate, so as to form exhaust gas blocking walls on the opposite sides of the folding edge of the exhaust guiding plate.

* * * * *